US009038204B2

(12) United States Patent
Walsh

(10) Patent No.: US 9,038,204 B2
(45) Date of Patent: May 26, 2015

(54) DRAIN GUARD

(76) Inventor: Barbara J. Walsh, Vandergrift, PA (US)

( * ) Notice: Subject to any disclaimer, the term of this patent is extended or adjusted under 35 U.S.C. 154(b) by 2284 days.

(21) Appl. No.: 11/443,605

(22) Filed: May 31, 2006

(65) Prior Publication Data

US 2006/0272080 A1 Dec. 7, 2006

Related U.S. Application Data

(60) Provisional application No. 60/686,173, filed on Jun. 1, 2005.

(51) Int. Cl.
*A47K 1/14* (2006.01)

(52) U.S. Cl.
CPC ..... *A47K 1/14* (2013.01)

(58) Field of Classification Search
CPC ..... A47K 1/14
USPC ..... 4/286, 292, DIG. 4; 15/105
See application file for complete search history.

(56) References Cited

U.S. PATENT DOCUMENTS

| | | | | | |
|---|---|---|---|---|---|
| 4,297,761 | A | * | 11/1981 | Loos | 15/105 |
| 4,409,692 | A | * | 10/1983 | Ness | 4/286 |
| 4,519,102 | A | | 5/1985 | Efstratis | |
| 4,745,642 | A | * | 5/1988 | Shands | 4/661 |
| 4,752,035 | A | | 6/1988 | Felder | |
| D333,342 | S | | 2/1993 | Newhard | |
| 5,271,108 | A | | 12/1993 | Wicke | |
| 5,404,596 | A | * | 4/1995 | Coory | 4/287 |
| 5,473,782 | A | | 12/1995 | Coakley | |
| 5,535,455 | A | | 7/1996 | Liu | |
| 6,108,828 | A | | 8/2000 | Cheng | |

* cited by examiner

*Primary Examiner* — Lori Baker
(74) *Attorney, Agent, or Firm* — James Ray & Assoc.

(57) ABSTRACT

A drain guard for a sink equipped with a garbage disposal having a flange attached to a surface of such sink and forming a sink drain opening includes a generally round and flat body member, a T-shaped grip attached to a top surface of the body member and a generally flat member extending outwardly and in a generally vertical direction from a bottom surface of the body member and which is capable of scraping solids from at least one of eating wear and such sink surface.

18 Claims, 2 Drawing Sheets

DRAIN GUARD

CROSS-REFERENCE TO RELATED APPLICATIONS

This application is related to and claims priority from U.S. Provisional Patent Application Ser. No. 60/686,173 filed Jun. 1, 2005.

FIELD OF THE INVENTION

The present invention relates, in general, to drain guards and, more particularly, this invention relates to a removable drain guard for a sink equipped with a garbage disposal.

BACKGROUND OF THE INVENTION

Drain plugs and particularly, drain guards for use in a sink equipped with a garbage disposal are well known in the art. U.S. Pat. No. 6,108,828 to Cheng, U.S. Pat. No. 5,535,455 to Liu, U.S. Pat. No. 5,271,108 to Wicke, U.S. Pat. No. 4,752,035 to Felder, U.S. Pat. No. 4,519,102 to Efsratis, and Des. 333,342 to Newhard describe various types of such drain guards. However, the prior art drain guards lack an ability to safely scrape the food solids from eating wear or sink surface into the sink drain opening and then subsequently into the garbage disposal.

U.S. Pat. No. 5,473,782 to Coackley attempts to resolve such disadvantage by disclosing a scraper disk fitted at the bottom of the drain guard. The outer edge of the scraper disk is adapted with fingers for allowing normal water flow, however the disk shape of such scraper and presence of fingers increase the effort of scraping the food solids.

SUMMARY OF THE INVENTION

According to one embodiment, the present invention provides a drain guard for a sink equipped with a garbage disposal having a flange attached to a surface of such sink and forming a sink drain opening. The drain guard includes a body member and a grip means attached to a top surface of the body member. A generally flat member extends outwardly from a bottom surface of the body member and is capable of scraping solids from at least one of eating wear and such sink surface.

According to another embodiment of the instant invention, there is provided an improvement for a drain guard used in a sink equipped with a garbage disposal having a flange attached to a surface of such sink and forming a sink drain opening. The improvement includes a generally flat scraper which extends outwardly and in a generally vertical direction from a bottom surface of the drain guard and which is capable of scraping solids from at least one of eating wear and such sink surface.

OBJECTS OF THE INVENTION

It is, therefore, one of the primary objects of the present invention to provide a drain guard for a sink equipped with a garbage disposal.

Another object of the present invention is to provide drain guard for a sink equipped with a garbage disposal having a scraper for scraping food solids.

Yet another object of the present invention is to provide a food scraper for a drain guard having a continuous edge surface.

A further object of the present invention is to provide a drain guard which is sized to fit within the sink drain opening.

Yet a further object of the present invention is to provide a drain guard which is simple and convenient to grip.

An additional object of the present invention is to provide a drain guard which is simple to manufacture.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
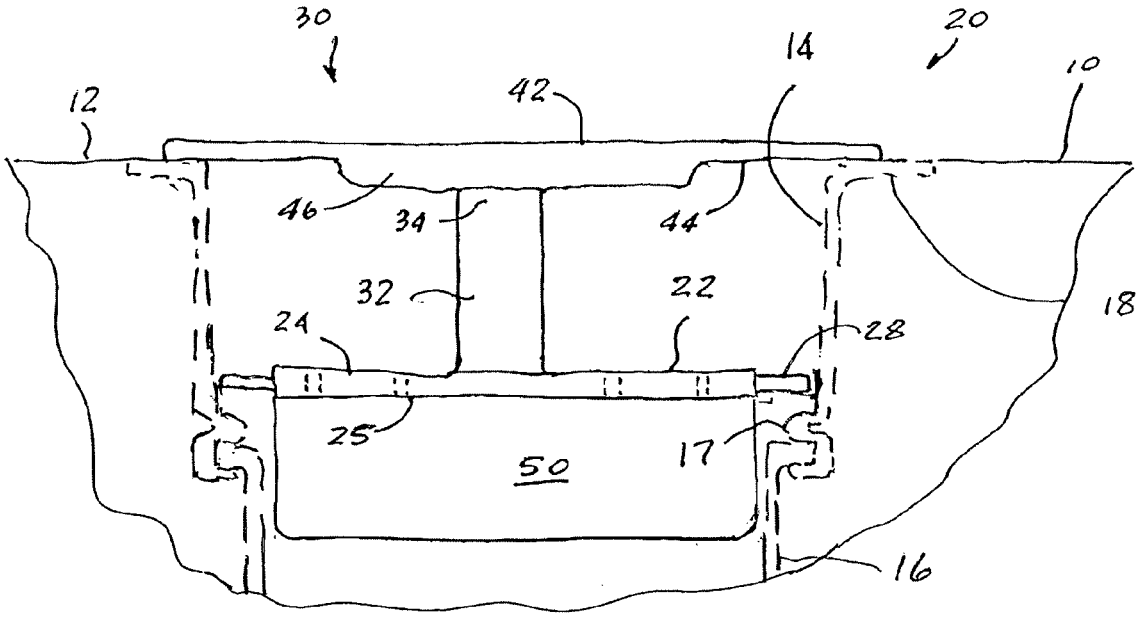
FIG. 1 is an elevation view of a drain guard constructed according to one embodiment of the present invention.
Figure 2:
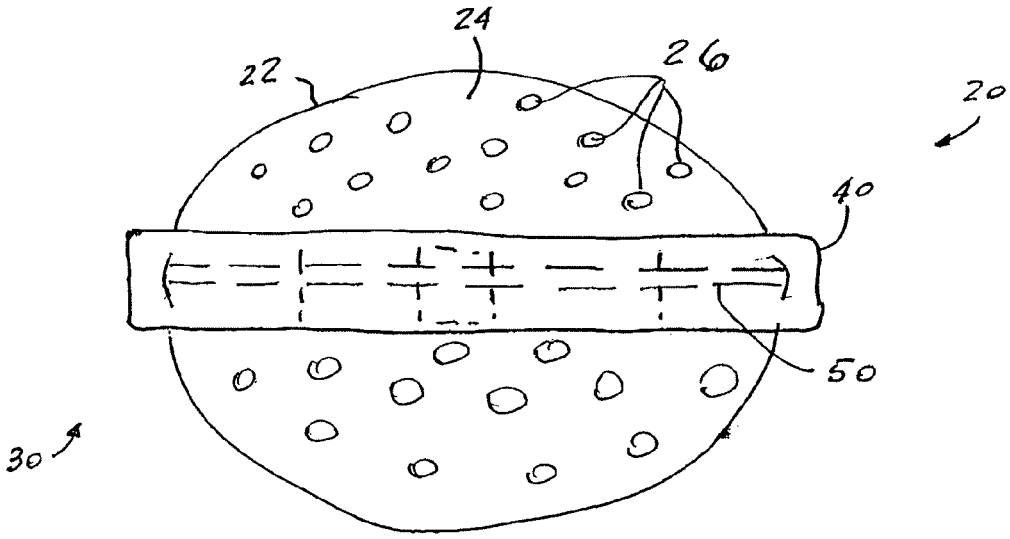
FIG. 2 is a plan view of the drain guard Illustrated in FIG. 1.

Prior to proceeding to the more detailed description of the present invention, it should be noted that, for the sake of clarity and understanding, identical components which have identical functions have been identified with identical reference numerals throughout the several views illustrated in the drawing figures.

Reference is now made, to FIGS. 1-4, wherein there is shown a drain guard, generally designated as 20, for a sink 10 equipped with a garbage disposal 16 having an annular flange 18 which is attached to a surface 12 of such sink 10 and forms a sink drain opening 14. The drain guard 20 includes a body 22 which preferably has a generally round and a generally flat shape. According to one embodiment of the invention, best shown in FIGS. 1 and 4, the body 22 of the drain guard 20 or the body 22" of the drain guard 20" is sized to fit into such sink drain opening 14. According to another embodiment of the present invention, best shown in FIG. 3, the body 22' is sized to overlap such sink drain opening 14. A plurality of apertures 26 are disposed within the body 22, 22' or 22" for enabling normal water and liquid flow into such sink drain opening 14. Preferably, the shape of each aperture 26 is generally round. The body 22 may be adapted with an annular sealing means 28 peripherally attached thereto for preventing water and solid waste discharge into such sink drain opening 14.

Another essential element of the present invention is a grip means, generally designated as 30, which is attached to a top surface 24 of the body 22. In the presently preferred embodiment of the invention, the grip means 30 includes a first member 32 extending upwardly and in a generally vertical direction from the top surface 24 of the body 22. Preferably, a longitudinal axis of such first member 32 is perpendicular to the plane of the body 22. A second member 40 is attached to a free end 34 of the first member 32. Preferably, the second member 40 is elongated and is disposed generally horizontally when the drain guard 20 is positioned for covering such sink drain opening 14. The top surface 42 of the second member 40 is generally smooth to prevent waste accumulation therewithin. To provide additional support during use of the drain guard 20, an abutment 46 is formed within a portion of a bottom surface 44 of the second member 40. Such abutment 46 is disposed adjacent the free end 34 of the first member 32.

Figure 4:
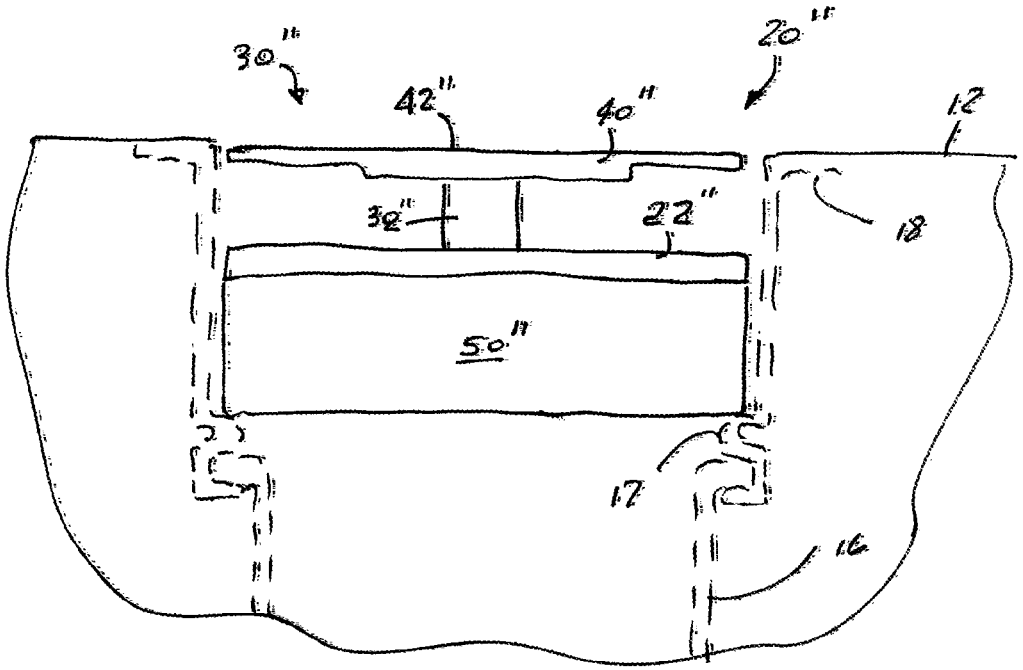
FIG. 4 is an elevation view of a drain guard constructed according to yet another embodiment of the present invention

Now in further reference to FIG. 1, when the body 22 is sized to fit within the sink drain opening 14, the second elongated member 40 is sized to overlap such sink drain opening 14. Alternatively, as best shown in FIG. 4, the length of the second elongated member 40" may be preselected to fit within the sink drain opening 14, thus enabling an apex of the grip means 30", and more particularly, the top surface 42" of the second member 40" to be disposed at or below the sink surface 12, which is advantageous for simply placing an article of cookware (not shown) onto such sink surface 12. The length of the first member 32" would be adjusted accordingly.

Figure 3:
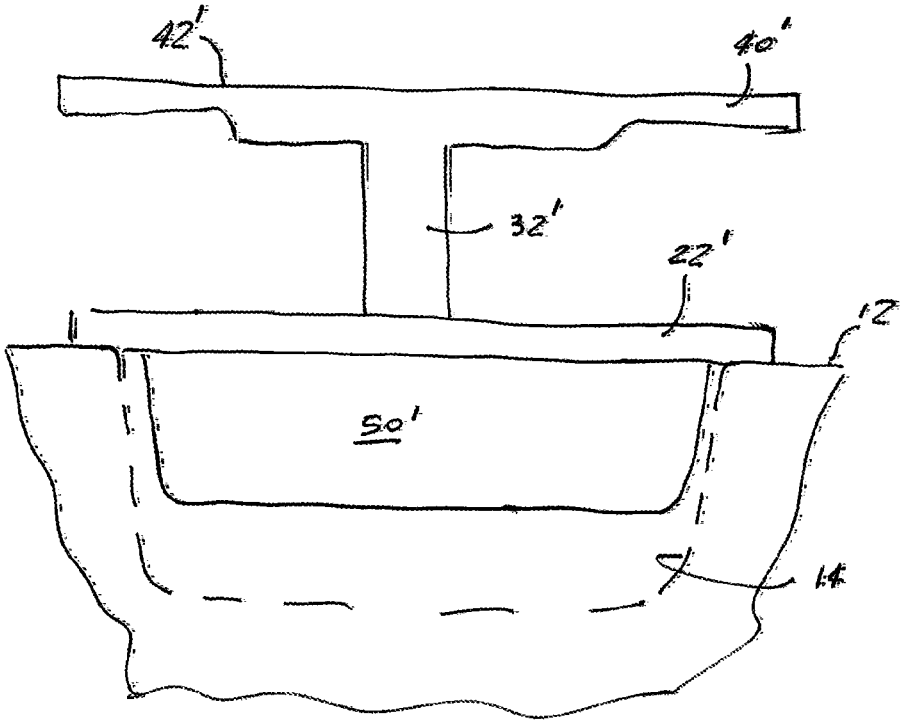
FIG. 3 is an elevation view of a drain guard constructed according to another embodiment of the present invention.

Yet another essential element of the present invention is a generally flat member 50 which extends outwardly and in a generally vertical direction from a bottom surface 25 of the body 22 and which is capable of scraping solids from at least one of eating ware and such sink surface 12. Preferably, the generally flat member 50 is made from a semi-rigid material such as plastic or elastomer and spans the width of the body 22. It is further preferred that the size of such generally flat member 50 is generally 1.5 inches in height, 2.5 inches in width and 0.125 inches in thickness, however, others sizes may be selected when required. When the body 22 is sized to fit within the sink drain opening 14, such generally flat member 50 is pushed through the splash guard (not shown) of the disposal 16 or a generally flat member 50' of FIG. 3 is sized to be disposed within the sink drain opening 14. The flat construction of the member 50 minimizes distortion of such splash guard (not shown). Alternatively, the height of the generally flat member 50" may be selected to support the drain guard 20 on an annular ledge 17 of the garbage disposal 16, as best shown in FIG. 4. In the most preferred embodiment of the present invention, the generally flat member 50 is disposed perpendicular to the body 22. In use, the solid waste is scraped in a simple generally linear motion.

To provide for economy of manufacturing cost, the drain guard 20 is manufactured as a one-piece construction. The material of the drain guard 20 may be one of plastic, elastomer, metal and various combinations thereof.

Although the present invention has been shown in terms of the drain guard for a sink equipped with a garbage disposal, it will be apparent to those skilled in the art, that the present invention may be applied to sink drains which are connected directly to the drain pipe.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those persons who are skilled in the relevant art without departing from the spirit and scope of the invention as set forth in the appended claims.

I claim:

1. A drain guard for a sink equipped with a garbage disposal having a flange attached to a surface of the sink and forming a sink drain opening, said drain guard comprising:

(a) a body disposed in a generally horizontal plane when said drain guard is positioned within the sink drain opening;

(b) a grip member attached to a top surface of said body;

(c) a generally flat member extending outwardly from a bottom surface of said body in a plane generally transverse to a plane of said bottom surface of said body, said generally flat member having a straight bottom edge disposed in a plane being generally parallel to said plane of said bottom surface of said body, said bottom edge scraping solids from at least one of eating wear and the sink surface; and (d) a plurality of apertures disposed within said body for enabling a liquid to flow into the sink drain opening, herein each of said plurality of apertures is generally round.

2. The drain guard, according to claim 1, wherein said body has at least one generally flat surface.

3. The drain guard, according to claim 1, wherein said body has a generally round peripheral edge.

4. The drain guard, according to claim 1, wherein said body is sized to overlap the sink drain opening.

5. The drain guard, according to claim 1, wherein said body is sized to fit into the sink drain opening.

6. The drain guard, according to claim 1, wherein said drain guard further includes a sealing member peripherally attached to said body.

7. The drain guard, according to claim 1, wherein said grip member includes a first member extending upwardly and in a generally vertical direction from said top surface of said body and a second member attached to an upper end of said first member.

8. The drain guard, according to claim 7, wherein said second member is elongated and is disposed generally horizontally when said drain guard is positioned for covering the sink drain opening.

9. The drain guard, according to claim 8, wherein a top surface of said second member is generally smooth.

10. The drain guard, according to claim 8, wherein said second member includes an abutment which is formed in a bottom surface thereof and which is attached to said upper end of said first member.

11. The drain guard, according to claim 8, wherein a length of said second member is preselected to overlap the sink drain opening and position a top surface of said second member in close proximity to the sink surface.

12. The drain guard, according to claim 8, wherein said first member is sized so as to position a top surface of said second member at or below the sink surface when said body is disposed within the sink drain opening.

13. The drain guard, according to claim 1, wherein said generally flat member is made from a semi-rigid material.

14. The drain guard, according to claim 1, wherein said generally flat member has a continuous edge.

15. The drain guard, according to claim 1, wherein said drain guard is manufactured as a one-piece construction.

16. The drain guard, according to claim 1, wherein a material of said drain guard is one of plastic, elastomer, metal and various combinations thereof.

17. In a drain guard for a sink equipped with a garbage disposal having a flange attached to a surface of the sink and forming a sink drain opening, the improvement wherein said drain guard includes each of an elongated grip and a generally flat scraper extending outwardly and in a generally vertical direction from a bottom surface of said drain guard, said scraper having a straight bottom edge disposed in a plane being generally parallel to a plane of said bottom surface of said body, said bottom edge scraping solids from at least one of eating wear and such sink surface.

18. A drain guard for a sink equipped with a garbage disposal having a flange attached to a surface of the sink and forming a sink drain opening, said drain guard consisting of:

(a) a generally round and planar body disposed in a generally horizontal plane when said drain guard is positioned within the sink drain opening;

(b) plurality of round apertures formed in a predetermined pattern through a thickness of said body and disposed inwardly from a peripheral edge thereof;

(c) an elongated generally flat grip member positioned in a spaced apart relationship with a top surface of said body;

(d) an elongated abutment provided on a bottom surface of said elongated flat grip member;

(e) an elongated member disposed in a generally vertical plane when said drain guard is positioned within the sink drain opening of a sink surface disposed in a generally horizontal plane and having each of a first end thereof disposed centrally on and attached to said top surface of said body and an opposed second end thereof disposed on and attached to a bottom surface of said elongated abutment; and (f) a generally flat elongated scraping member extending outwardly in said generally vertical plane from said bottom surface of said body, said generally flat scraping member having a generally straight bottom edge thereof disposed in a plane being generally parallel to said plane of said bottom surface of said body, wherein a length of said scraping member defined by a pair of spaced apart side edges is greater than a height thereof defined by a distance between said bottom edge of said scraping member and said bottom surface of said body.

* * * * *